US006981395B2

(12) United States Patent
Ryu et al.

(10) Patent No.: US 6,981,395 B2
(45) Date of Patent: Jan. 3, 2006

(54) DRUM TYPE WASHING MACHINE

(75) Inventors: Doo-Young Ryu, Suwon (KR); Koan-Seog Namkung, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 314 days.

(21) Appl. No.: 10/223,472

(22) Filed: Aug. 20, 2002

(65) Prior Publication Data

US 2003/0061842 A1 Apr. 3, 2003

(30) Foreign Application Priority Data

Sep. 28, 2001 (KR) ..... 2001-60366

(51) Int. Cl.
*D06F 39/08* (2006.01)

(52) U.S. Cl. ..... 68/17 R; 68/207; 68/902

(58) Field of Classification Search ..... 68/18 R, 68/207, 902, 17 R
See application file for complete search history.

(56) References Cited

U.S. PATENT DOCUMENTS 1,580,640 A * 4/1926 Bibby ..... 68/148
1,940,241 A * 12/1933 Bovee ..... 68/23.5
2,287,927 A * 6/1942 Altorfer ..... 68/23.5
2,588,774 A * 3/1952 Smith ..... 68/12.13
2,721,574 A * 10/1955 Parker ..... 137/122
2,809,650 A * 10/1957 Anderson ..... 137/13
2,924,959 A * 2/1960 Israel, Jr. ..... 68/18 F
2,936,605 A * 5/1960 Loutrel ..... 68/23.7
4,624,118 A * 11/1986 Yamakawa et al. ..... 68/12.21
4,835,994 A * 6/1989 Ishida et al. ..... 68/174
5,241,843 A * 9/1993 Hein ..... 68/3 R (Continued)

FOREIGN PATENT DOCUMENTS

DE 42 28 250 * 1/1994
DE 198 37 881 * 2/2000
JP 59-131392 * 7/1984

(Continued)

OTHER PUBLICATIONS

European Patent Office 449,060 Oct. 1991.*

(Continued)

*Primary Examiner*—Frankie L. Stinson
(74) *Attorney, Agent, or Firm*—Staas & Halsey LLP

(57) ABSTRACT

A drum type washing machine includes a cabinet, a fixed drum set in the cabinet to contain wash water therein, a rotary drum rotatably set inside the fixed drum, a pump which forcibly pumps out the wash water contained in the fixed drum, and a water circulation device which feeds the wash water pumped by the pump into the rotary drum in a washing operation. The water circulation device includes a storing unit and a spraying unit. The storing unit defines a space which temporarily holds the wash water pumped by the pump, and is provided between rear panels of the fixed drum and the rotary drum. The storing unit guides the wash water to the rear panel of the rotary drum. The spraying unit is provided at the rear panel of the rotary drum, and sprays the wash water contained in the storing unit into the rotary drum.

19 Claims, 5 Drawing Sheets

U.S. PATENT DOCUMENTS

| | | | | | |
|---|---|---|---|---|---|
| 5,285,665 | A | * | 2/1994 | Hetrick, Jr. | 68/18 F |
| 5,431,032 | A | * | 7/1995 | Oberg | 68/207 |
| 5,617,885 | A | * | 4/1997 | Centis | 134/58 D |
| 5,660,193 | A | * | 8/1997 | Archer et al. | 134/56 D |
| 5,724,690 | A | * | 3/1998 | Babuin et al. | 8/158 |
| 5,778,471 | A | * | 7/1998 | Collison | 8/158 |
| 5,829,459 | A | * | 11/1998 | Milocco et al. | 134/57 D |
| 5,899,097 | A | * | 5/1999 | Adler | 68/18 R |
| 6,167,733 | B1 | | 1/2001 | Lee | |

FOREIGN PATENT DOCUMENTS

| | | | |
|---|---|---|---|
| JP | 60-2279 | * | 1/1996 |
| JP | 9-75589 | * | 3/1997 |
| KR | 1998-067224 | | 12/1998 |

OTHER PUBLICATIONS

European Patent Office 607,628 Jul. 1994.*
European Patent Office 771,898 Oct. 1995.*

* cited by examiner

DRUM TYPE WASHING MACHINE

CROSS-REFERENCE TO RELATED APPLICATIONS

This application claims the benefit of Korean Patent Application No. 2001-60366 filed on Sep. 28, 2001, in the Korean Industrial Property Office, the disclosure of which is incorporated herein by reference.

BACKGROUND OF THE INVENTION

1. Field of the Invention

The present invention relates to a washing machine, and more particularly, to a drum type washing machine having a water circulation device which pumps wash water contained in a fixed drum to feed the wash water to a rotary drum, so as to enhance the washing effect.

2. Description of the Related Art

Generally, a drum type washing machine is an appliance designed to wash laundry by dropping the laundry from a top to a bottom inside of a rotary drum as the rotary drum is rotated. Such a drum type washing machine includes a fixed drum, a rotary drum and shock absorbing members. The fixed drum is suspended in a box-shaped cabinet which defines an outer appearance of the washing machine, and contains wash water therein. The rotary drum is set in the fixed drum so as to be rotatable in alternating directions. The shock absorbing members support the fixed drum in the box-shaped cabinet.

In conventional drum type washing machines, washing, rinsing, and spin-drying operations are automatically carried out according to a previously input program, while a rotary drum is rotated. In this case, washing courses are classified into a heavy course, a normal course, a wool course, etc., according to a kind and state of laundry to be washed. However, the conventional drum type washing machines are limited in their washing efficiency, because the washing and rinsing operations are achieved only by dropping of the laundry through the rotation of the rotary drum.

To overcome this problem, Korean U.M. Application No. 1997-11762/Laid-Open Publication No. 1998-67224 discloses a wash water circulation device for drum type washing machines. The wash water circulation device forcibly pumps wash water in a fixed drum and sprays the wash water into a rotary drum containing laundry therein.

FIG. 1 shows that the wash water circulation device disclosed above includes a spray nozzle 3 which sprays the wash water pumped from the bottom to the top inside of a tub (the fixed drum) 2 by a drain pump 1, a first solenoid valve 4 which is installed at a position adjacent to the spray nozzle 3 and closes during a drain operation and opens during a washing operation, a water circulation hose 6 having one end connected to the spray nozzle 3 and the other end connected to a T-shaped connector 7 positioned between the drain pump 1 and a drain hose 5, and a second solenoid valve 8 which is installed at an inlet of the drain hose 5 and closes during the washing operation.

The spray nozzle 3 is positioned on top of the tub 2, so as to have the wash water sprayed from the spray nozzle 3 to flow into a drum (the rotary drum) 9 through a plurality of spin-drying perforations 9*a* formed on a wall of the drum 9. The second solenoid valve 8 prevents the wash water pumped by the drain pump 1 from being drained through the drain hose 5 during the washing operation.

Thus, where the drain pump 1 is activated during the washing operation, which is carried out by rotation of the drum 9, the wash water in the tub 2 is pumped to the top of the tub 2 and then sprayed downward therefrom. That is, the wash water pumped by the drain pump 1 is guided to the spray nozzle 3 through the water circulation hose 6 and then sprayed from the spray nozzle 3 to the drum 9 to flow into the drum 9 through the perforations 9*a*, so as to improve the washing efficiency and solubility of detergent.

However, since the wash water sprayed from the spray nozzle 3 is first sprayed against an external wall of the drum 9, only a small portion of the sprayed wash water flows into the drum 9 through the perforations 9*a*. The remaining wash water flows down along the external wall of the drum 9 and is collected in the bottom of the tub 2.

Therefore, although the solubility of the detergent can be improved by circulation of the wash water, the sprayed wash water achieves limited improvement in washing the laundry.

SUMMARY OF THE INVENTION

Accordingly, it is an object of the present invention is to provide a drum type washing machine with an improved water circulation device, which sprays wash water directly into a rotary drum containing laundry therein during a washing operation. Accordingly, a washing efficiency of the laundry and solubility of detergent are enhanced.

Additional objects and advantages of the invention will be set forth in part in the description which follows and, in part, will be obvious from the description, or may be learned by practice of the invention.

To achieve the above and other objects of the present invention, there is provided a drum type washing machine comprising a cabinet which defines an outer appearance of the washing machine, a fixed drum set in the cabinet to contain wash water therein, a rotary drum rotatably set inside the fixed drum, a pump unit which pumps out the wash water contained in the fixed drum, a water circulation device which feeds the wash water pumped out by the pump unit into the rotary drum, wherein the water circulation device comprises a storing unit which defines a space to temporarily hold the wash water pumped out by the pump unit, guides the wash water to a rear panel of the rotary drum, and is provided between a rear panel of the fixed drum and the rear panel of the rotary drum, and a spraying unit which is provided at the rear panel of the rotary drum and sprays the wash water contained in the storing unit into the rotary drum.

The water circulation device further comprises a duct which is provided on an outer surface of the rear panel of the fixed drum, communicates with the storing unit, and includes a connecting port connected to an outlet of the pump.

The drum type washing machine further comprises a shaft-flange which is mounted to the rear panel of the rotary drum, and includes a center portion which receives a rotating shaft of the washing machine, wherein the storing unit includes a first projecting member having a ring shape and provided at a center portion of the rear panel of the fixed drum so as to be projected toward the rotary drum, a second projecting member which is provided at the shaft-flange so as to be projected toward the rear panel of the fixed drum and surrounds the first projecting member to form the space, and a sealing unit which seals a gap between the first and second projecting members.

The sealing unit comprises a friction ring arranged between an outer circumference of the first projecting member and an inner circumference of the second projecting member, and a retainer having a ring shape which holds the friction ring, wherein an outer edge of the retainer is inserted into the friction ring and an inner edge of the retainer is mounted to the first projecting member.

The spraying unit comprises a guide hole which is formed outside a fixed part of the shaft-flange, and guides the wash water held in the storing unit to a center portion of the rear panel of the rotary drum, an opening formed on the center portion of the rear panel of the rotary drum to correspond to the guide hole, and a nozzle which is mounted inside the rear panel of the rotary drum and includes perforations to spray the wash water passing through the guide hole and the opening into the rotary drum.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
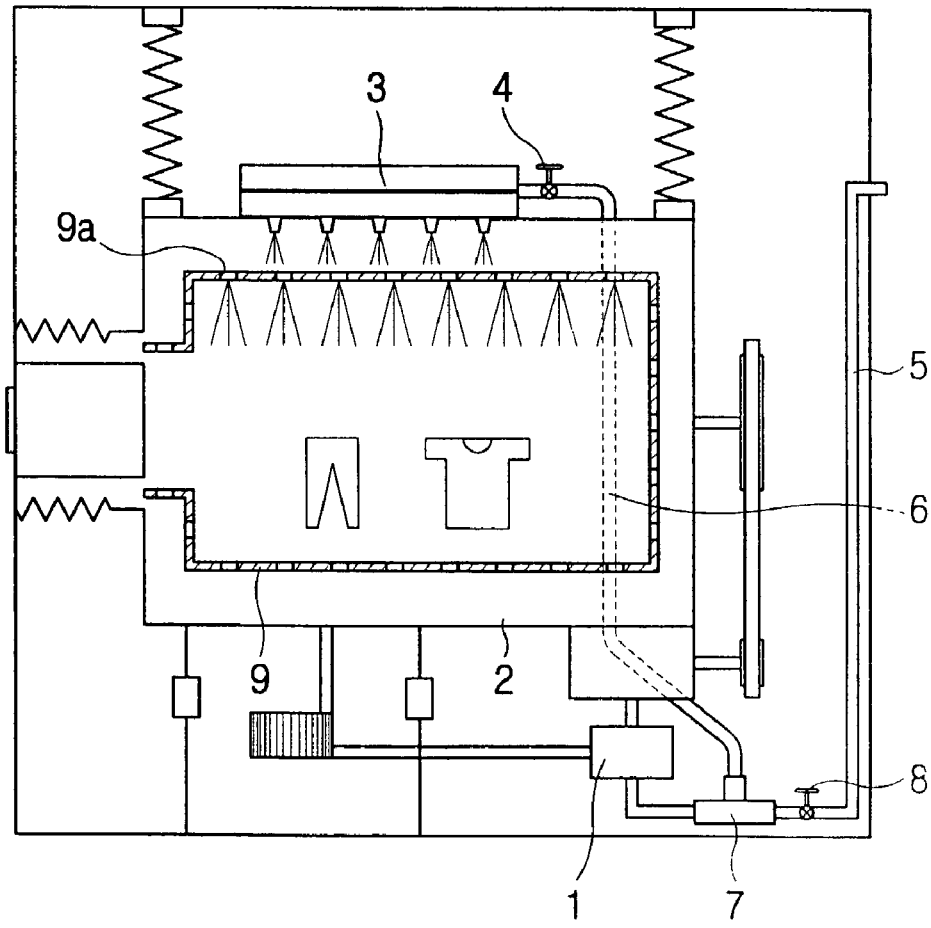
FIG. 1 (PRIOR ART)
FIG. 1 is a sectional view showing a drum type washing machine with a conventional water circulation device.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
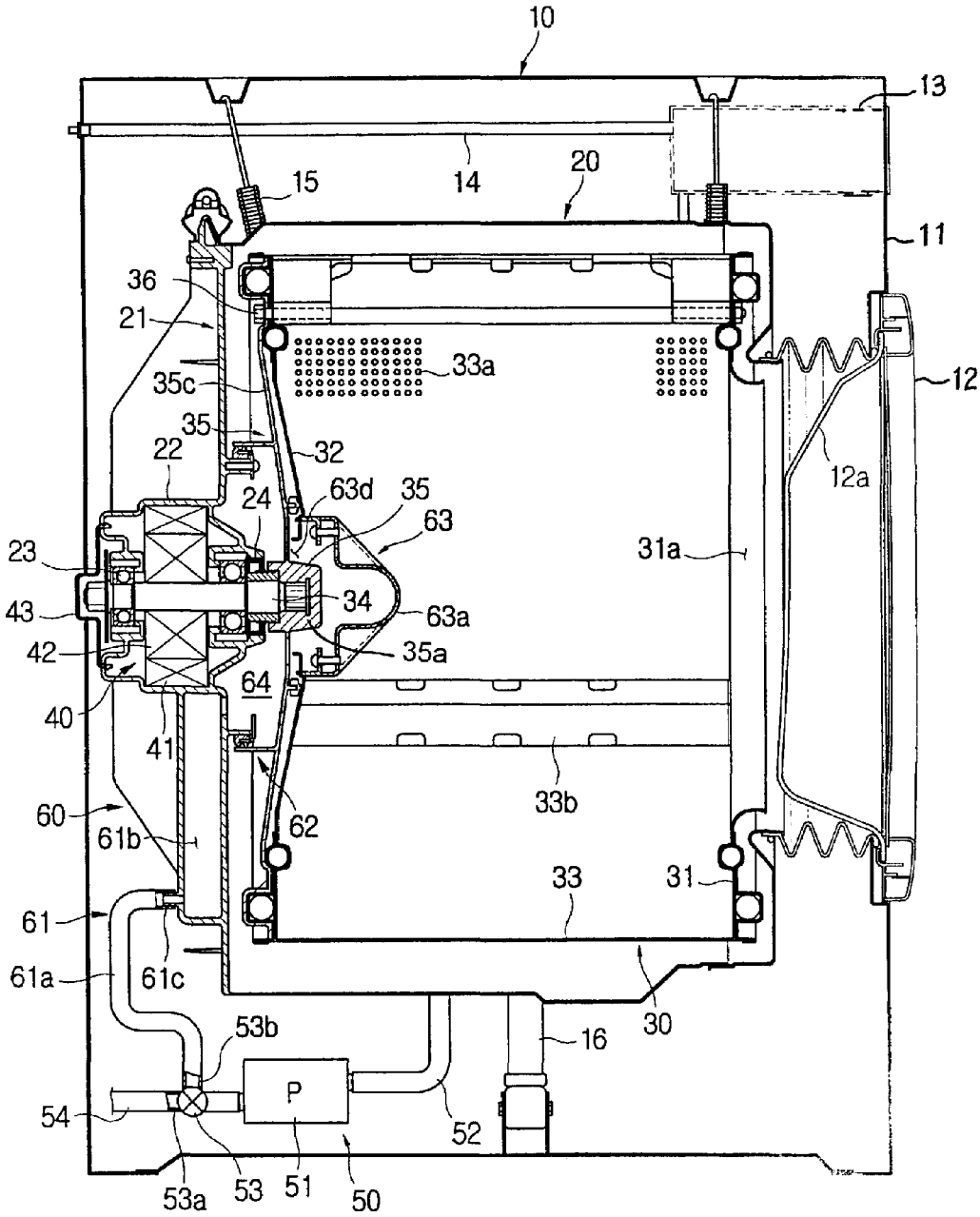
FIG. 2 is a side-sectional view showing the structure of a drum type washing machine according to an embodiment of the present invention.

FIG. 2 shows a drum type washing machine according to an embodiment of the present invention. The drum type washing machine includes a hexahedral cabinet ("cabinet") 10 to which a front door 12 is mounted. A fixed drum 20 is horizontally suspended in the cabinet 10 to contain wash water therein. A rotary drum 30 is set inside the fixed drum 20 to be rotatable in opposite directions. The drum type washing machine also includes a drive unit 40 which actuates the rotary drum 30, and a drain unit 50 which forcibly drains the wash water from the fixed drum 20 in a draining operation. Furthermore, the drum type washing machine is provided with a water circulation device 60 which feeds the wash water in the fixed drum 20 to the rotary drum 30 in washing and rinsing operations.

The cabinet 10 defines an outer appearance of the drum type washing machine ("washing machine"), and has a circular opening at its front which allows a user to place laundry in the washing machine or remove the laundry from the washing machine. The front door 12 is hinged to a front of the washing machine to selectively close the circular opening. A transparent window 12*a* made of glass forms a center portion of the front door 12, so as to allow the user to see the inside of the rotary drum 30 even though the front door 12 is closed. In addition, a detergent container 13 is arranged at an upper position inside the cabinet 10. Water supplied from an external water supply source passes through a water supply hose 14 and the detergent container 13, and then is fed into the fixed drum 20.

The fixed drum 20 is a cylindrical drum horizontally suspended in the cabinet 10 by using, for example, a plurality of shock absorbing springs 15 and shock absorbing members 16. That is, the top of the fixed drum 20 is hung from the top of the cabinet 10 by the shock absorbing springs 15, while the bottom of the fixed drum 20 is supported at the bottom of the cabinet 10 by the shock absorbing members 16. A center portion of a rear panel 21 of the fixed drum 20 is integrally provided with a bearing housing 22 in which a bearing 23 and an oil seal 24 are fitted so as to rotatably support a rotating shaft 34 described hereinafter, and prevent the wash water from leaking.

The rotary drum 30 is concentrically set inside the fixed drum 20, and includes a front panel 31, a rear panel 32 to which the rotating shaft 34 is mounted, and a cylindrical side panel 33. An opening 31*a* is formed at the front panel 31, and allows the user to place the laundry into the rotary drum 30 or remove the laundry from the rotary drum 30. The cylindrical side panel 33 connects the front panel 31 to the rear panel 32, has a cylindrical shape and is perforated to form spin-drying perforations 33*a*. Lifters 33*b* bent to form a "V" shape are regularly placed on the side panel 33 of the rotary drum 30 at angular intervals of 120 degrees, and cause the laundry seated on an internal surface of the rotary drum 30 to repeatedly move upward and be dropped from the top to the bottom inside of the rotary drum 30 during rotation of the rotary drum 30.

A shaft-flange 35 is mounted to the rear panel 32 of the rotary drum 30 by mounting bolts 36, with the rotating shaft 34 mounted to the shaft-flange 35. The shaft-flange 35 has, at its center portion, a fixed part 35*a* and mounting parts 35*c* regularly branched from the fixed part 35*a* in radial directions. In this case, the fixed part 35*a* holds one end of the rotating shaft 34, while the mounting parts 35*c* receive the mounting bolts 36. The fixed part 35*a* is provided with a shaft holding hole 35*b* (see FIG. 5), so as to firmly hold the one end of the rotating shaft 34 in the shaft holding hole 35*b* through a serration-engagement. That is, the one end of the rotating shaft 34 is mounted to the center portion of the rear panel 32 of the rotary drum 30 by the shaft-flange 35, whereas the other end is rotatably supported by the bearing 23 set in the bearing housing 22 and is connected to the drive unit 40.

The drive unit 40 is externally mounted to the rear panel 21 of the fixed drum 20, and includes a stator 41, a rotor 42, and a cover 43. The stator 41 is firmly mounted to an inner circumference of the bearing housing 22. The rotor 42 is set inside the stator 41. In this case, the rotating shaft 34 rotatably supported by the bearing 23 is fitted into a center portion of the rotor 42. The cover 43 is attached to the bearing housing 22 and closes the housing 22. With an operation of the rotor 42 in conjunction with the stator 41 of the electrically activated drive unit 40, the rotating shaft 34 is rotated in opposite directions together with the rotary drum 30 by the rotor 42 during the washing and rinsing operations. A control unit (not shown) of this drum type washing machine is programmed so as to rotate the rotor 42 in one direction by controlling a power supply during a spin-drying operation.

The drain unit 50 includes a pump 51 which is connected, at its inlet, to a connecting hose 52 to communicate with the bottom of the fixed drum 20, a three-way valve 53 provided at an outlet of the pump 51, and a drain hose 54 which is connected to the outlet of the three-way valve 53. The drain hose 54 discharges the wash water to the outside. The three-way valve 53 switches a flow direction of the wash water according to a mode selection between water draining and circulating modes. The three-way valve 53 includes a first outlet 53*a* connected to the drain hose 54, and a second outlet 53*b* connected to a guide hose 61*a* of the water circulation device 60. That is, the three-way valve 53 is actuated so as to have the wash water pumped by the pump 51 flow into the first outlet 53*a* in a draining operation, and flow into the second outlet 53*b* in the washing and rinsing operations. Such an operation of the three-way valve 53 is pre-programmed into the control unit of the washing machine.

The water circulation device 60 includes a guide unit 61, a storing unit 62, and a spraying unit 63. The guide unit 61 guides the wash water pumped by the pump 50 between the rear panel 21 of the fixed drum 20 and the shaft-flange 35. The storing unit 62 defines a storing space 64 which temporarily holds the wash water passing through the guide unit 61, and is provided between the shaft-flange 35 and the rear panel 21 of the fixed drum 20 to guide the wash water contained in the storing unit 62 to the rear panel 32 of the rotary drum 30. The spraying unit 63 is provided at a center portion of the rear panel 32 of the rotary drum 30, and is used to spray the wash water contained in the storing unit 62 into the rotary drum 30. The construction of the guide unit 61, storing unit 62, and spraying unit 63 will be described in detail below with reference to FIGS. 3-5.

Figure 3:
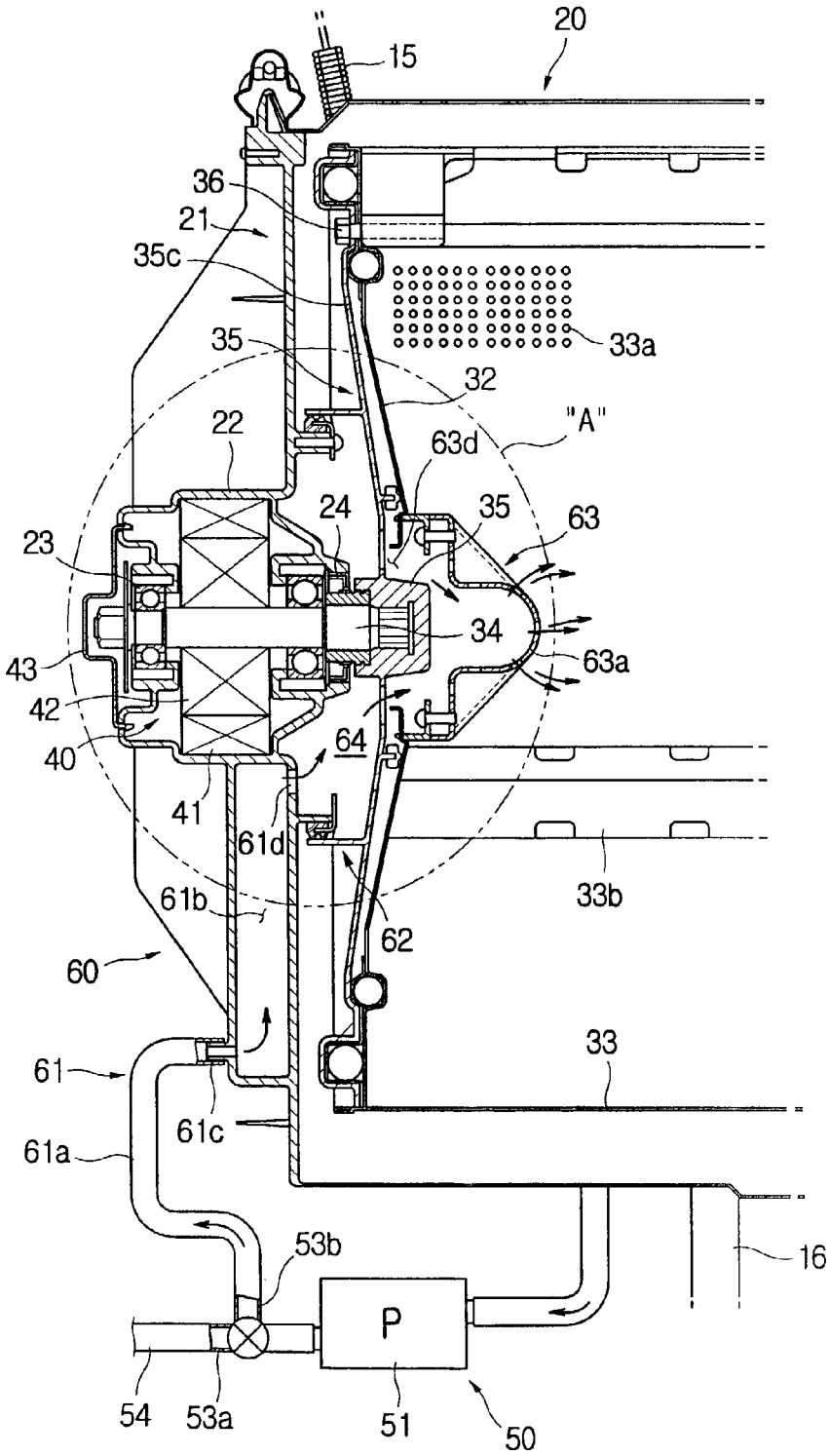
FIG. 3 is a sectional view showing a rear part of the drum washing machine shown in FIG. 2.
Figure 4:
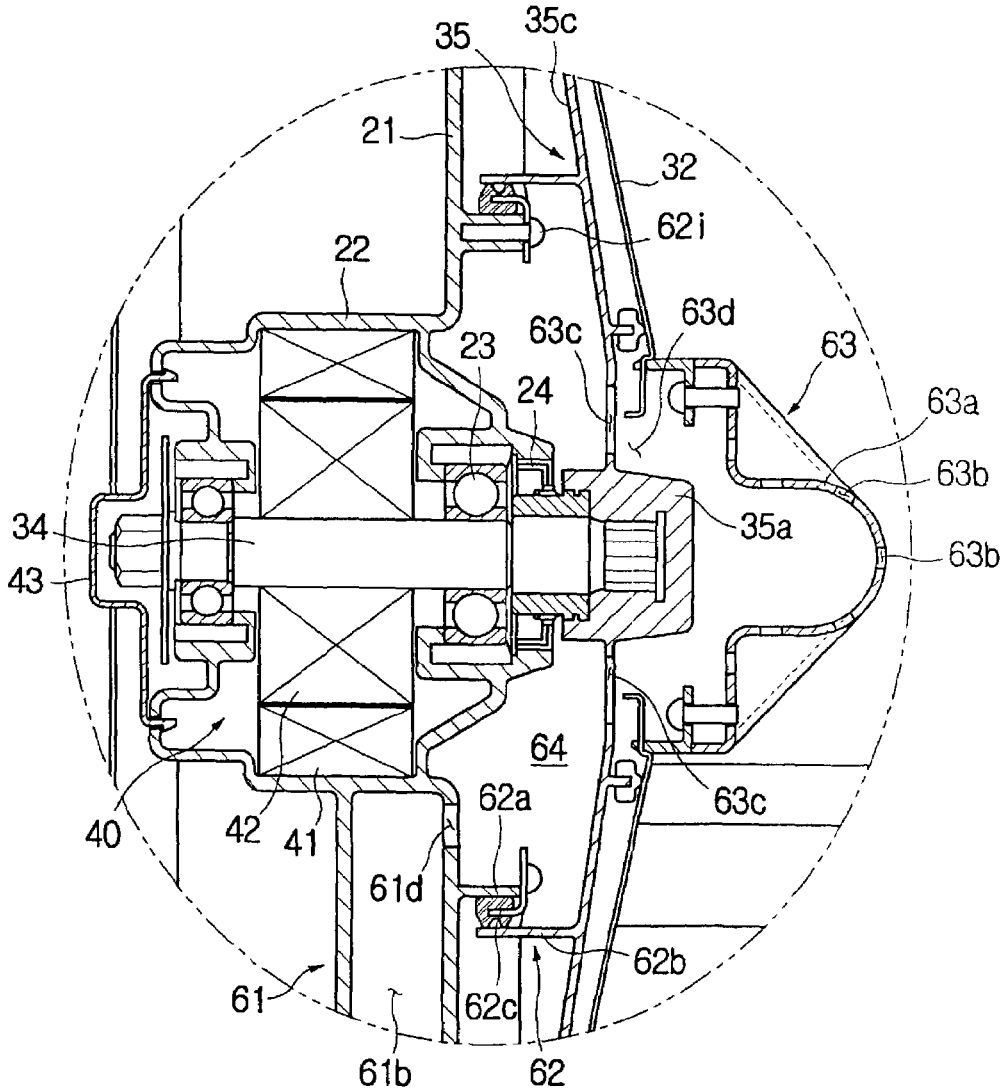
FIG. 4 is a view of a portion "A" encircled in FIG. 3.

As shown in FIGS. 3 and 4, the guide unit 61 includes the guide hose 61*a* and a duct 61*b*. The guide hose 61*a* is connected, at its one end, to the second outlet 53*b* of the three-way valve 53, while being connected, at the other end, to a connecting port 61*c*. The connecting port 61*c* is provided at the duct 61*b* which is externally provided on the rear panel 21 of the fixed drum 20. A communicating hole 61d is formed on an upper portion of the duct 61*b* to communicate with the storing space 64 of the storing unit 62. The duct 61*b* having the connecting port 61*c* may be integrated with the rear panel 21 of the fixed drum 20 which is manufactured, for example, through a plastic injection molding method.

Figure 5:
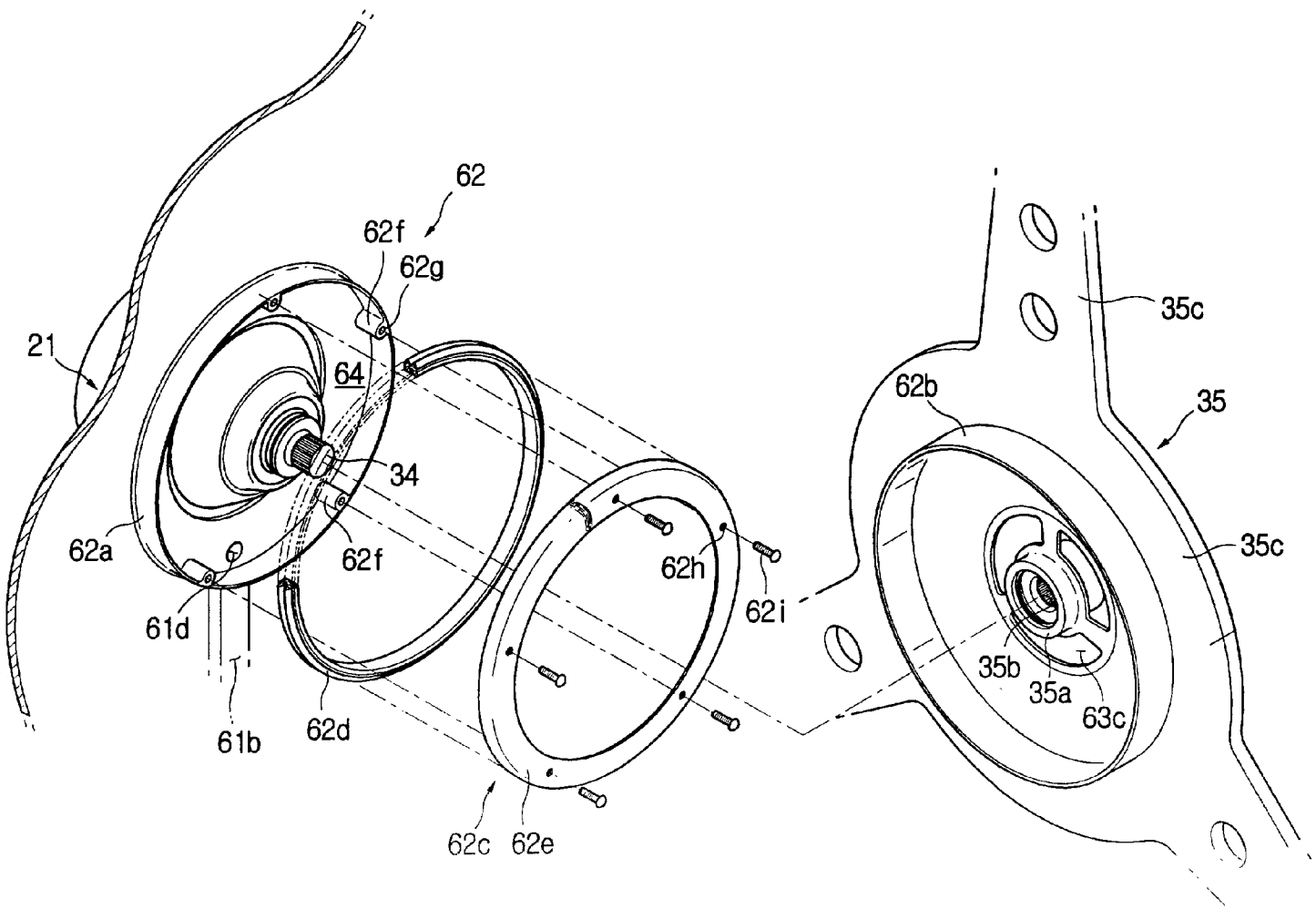
FIG. 5 is an exploded perspective view showing a storing unit included in the water circulation device of the drum type washing machine shown in FIG. 2.

Referring to FIGS. 4 and 5, the storing unit 62 includes a first projecting member 62*a*, a second projecting member 62*b*, and a sealing unit 62*c*. The first projecting member 62*a* has a ring shape, and is provided at a center portion of the rear panel 21 of the fixed drum 20 so as to be projected toward the rotary drum 30. The second projecting member 62*b* is provided at the shaft-flange 35 so as to be projected toward the rear panel 21 of the fixed drum 20, and surrounds the first projecting member 62*a*. The sealing unit 62*c* is used to seal a gap between the first and second projecting members 62*a* and 62*b*.

The first projecting member 62*a* may be integrally formed on an inner surface of the rear panel 21 of the fixed drum 20 through, for example, an injection molding method, so as to be concentric with the fixed drum 20. The second projecting member 62*b* may be integrally manufactured with the shaft-flange 35 made of an aluminum alloy. The second projecting member 62*b* surrounds the first projecting member 62*a* to form the storing space 64 which temporarily holds the wash water around the rotating shaft 34. The sealing unit 62*c* allows the shaft-flange 35 to be smoothly rotated together with the rotary drum 30 while preventing the wash water held in the storing space 64 from leaking out. The sealing unit 62*c* includes a friction ring 62*d* and a retainer 62*e*. In this case, the friction ring 62*d* is interposed between an outer circumference of the first projecting member 62*a* and an inner circumference of the second projecting member 62*b*, and is made of, for example, an elastic material. The ring-shaped retainer 62*e* is designed so as to have its outer edge inserted into the friction ring 62*d*, and its inner edge mounted to the first projecting member 62*a*.

To assemble the sealing unit 62*c* with first and second projecting members 62*a* and 62*b*, bosses 62*f* each having a screw hole 62*g* are provided along the inner circumference of the first projecting member 62*a* at regular intervals, and through holes 62*h* are formed along the inner edge of the retainer 62*e* at positions corresponding to the screw holes 62*g*. Thus, when screws 62*i* are tightened into the screw holes 62*g* after passing the through holes 62*h* aligned with the screw holes 62*g*, the sealing unit 62*c* is firmly mounted to the first projecting member 62*a* while the friction ring 62*d* surrounds the outer circumference of the first projecting member 62*a*.

The spraying unit 63 is used to spray the wash water held in the storing space 64 into the rotary drum 30. The spraying unit 63 includes a nozzle 63*a*, guide holes 63*c*, and an opening 63*d*. The nozzle 63*a* is internally mounted at the center portion of the rear panel 32 of the rotary drum 30, and has perforations 63*b*. The guide holes 63*c* are radially formed outside the fixed part 35*a* of the shaft-flange 35, and the opening 63*d* is formed on the center portion of the rear panel 32 to correspond to the guide holes 63*c*. In such a construction, the wash water held in the storing space 64 flows into the nozzle 63*a* through the guide holes 63*c* and the opening 63*d*, and is sprayed into the rotary drum 30 through the perforations 63*b* of the nozzle 63*a*. Such an operation will be described in detail below.

An operation and effect of the washing machine having the above structure is as follows.

First, a user may open the front door 12, place laundry in the rotary drum 30, and manipulate a control panel (not shown) to actuate the washing machine. Where the washing machine is actuated, an appropriate quantity of water is supplied into the fixed drum 20 together with detergent contained in the detergent container 13 according to the amount of the laundry.

During washing and rinsing operations, the rotor 42 of the drive unit 40 is rotated in opposite directions, thus making the rotating shaft 34 rotate in the opposite directions along with the rotary drum 30. As the rotary drum 30 is rotated, the laundry rolls, or is washed by being repeatedly moved upward by the lifters 33*b* and dropped from the top to the bottom inside of the rotary drum 30.

Furthermore, where the pump 51 of the drain unit 50 is actuated during the washing and rinsing operations, the wash water is pumped from a bottom to a top inside of the fixed drum 20, guided to the three-way valve 53 and the water circulation device 60, and sprayed from the center portion of the rear panel 32 of the rotary drum 30, as shown by the arrows of FIG. 3.

That is, the wash water contained in the fixed drum 20 sequentially passes through the second outlet 53*b* of the three-way valve 53, the guide hose 61, and the duct 61*b*, and is temporarily held in the storing space 64 of the storing unit 62. Subsequently, the wash water is fed into the nozzle 63*a* through the guide holes 63*c* and the opening 63*d*, and sprayed into the rotary drum 30, which is rotated in the opposite directions, through the perforations 63*b* of the nozzle 63*a*. Such a water circulating operation is continuously repeated during the washing and rinsing operations. In this case, the wash water held in the storing space 64 of the storing unit 62 is fed to the nozzle 63*a* without leaking due to the sealing unit 62*c*.

Accordingly, the laundry is more rapidly wetted by the wash water sprayed through the nozzle 63*a* in an initial washing operation. In addition, the wash water is directly sprayed onto the laundry, thus achieving an improved and desired washing effect with less consumption of water.

Since the detergent sinking to the bottom of the fixed drum 20 is circulated along with the wash water, the detergent is also rapidly dissolved. Therefore, the washing effect is further enhanced, which, in turn, shortens a wash time.

In a draining operation, the second outlet 53*b* of the three-way valve 53 is closed while the first outlet 53*a* is opened. Therefore, the wash water forcibly pumped by the pump 51 is discharged to the outside through the drain hose 54.

As described above, a drum type washing machine of the present invention is designed so as to have wash water being pumped by a pump be directly sprayed onto laundry from a center portion of a rear panel of a rotary drum, which is rotated in opposite directions during washing and draining operations. Thus, the circulating wash water allows a detergent to be rapidly dissolved. In addition, the wash water is directly sprayed onto the laundry so as to rapidly wet the laundry, improve the washing effect and consume less water.

It is understood that the present invention is not limited to a drum type washing machine having a water circulation device. Rather the water circulation device of the present invention can be applied to other types of washing machines.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A drum type washing machine comprising:

a cabinet which defines an outer appearance of the washing machine;

a fixed drum set in the cabinet to contain wash water therein;

a rotary drum rotatably set inside the fixed drum;

a pump unit which pumps out the wash water contained in the fixed drum; and a water circulation device which feeds the wash water pumped out by the pump unit into the rotary drum, wherein the water circulation device comprises:

a storing unit which defines a space to temporarily hold the wash water, guides the wash water to a rear panel of the rotary drum, and is provided between a rear panel of the fixed drum and the rear panel of the rotary drum, and a spraying unit which is provided at the rear panel of the rotary drum, and sprays the wash water contained in the storing unit into the rotary drum.

2. The drum type washing machine according to claim 1, wherein the water circulation device further comprises a duct which is provided on an outer surface of the rear panel of the fixed drum, communicates with the storing unit, and includes a connecting port connected to an outlet of the pump.

3. The drum type washing machine according to claim 2, further comprising a valve which is provided between the connecting port of the duct and the outlet of the pump unit, and guides the wash water to the duct and a wash water drain hose of the washing machine according to operation of the washing machine.

4. The drum type washing machine according to claim 2, wherein the duct is integrally formed with the rear panel of the fixed drum.

5. The drum type washing machine according to claim 1, further comprising a shaft-flange which is mounted to the rear panel of the rotary drum, and includes a center portion which receives a rotating shaft of the washing machine, wherein the storing unit comprises:

a first projecting member having a ring shape and provided at a center portion of the rear panel of the fixed drum so as to be projected toward the rotary drum;

a second projecting member provided at the shaft-flange so as to be projected toward the rear panel of the fixed drum, and surrounds the first projecting member to form the space; and a sealing unit which seals a gap between the first and second projecting members.

6. The drum type washing machine according to claim 5, wherein the sealing unit comprises:

a friction ring arranged between an outer circumference of the first projecting member and an inner circumference of the second projecting member; and a retainer having a ring shape which holds the friction ring, wherein an outer edge of the retainer is inserted into the friction ring and an inner edge of the retainer is mounted to the first projecting member.

7. The drum type washing machine according to claim 5, further comprising:

a door provided to a front of the cabinet;

a detergent container to contain detergent therein;

a water supply hose which is connected to the detergent container and supplies the wash water to the fixed drum;

a drive unit which actuates the rotating shaft to drive the rotary drum; and lifters which are arranged on an interior surface of the rotary drum, and move laundry contained in the rotary drum upward and drop the laundry from a top to a bottom inside of the rotary drum.

8. The drum type washing machine according to claim 5, wherein the first projection member is integrally formed on an inner surface of the rear panel of the fixed drum.

9. The drum type washing machine according to claim 5, wherein the second projection member is integrally formed with the shaft-flange.

10. The drum type washing machine according to claim 1, wherein the spraying unit comprises:

a guide hole which is formed on a fixed part of the shaft-flange, and guides the wash water held in the storing unit to a center portion of the rear panel of the rotary drum;

an opening formed on the center portion of the rear panel of the rotary drum to correspond to the guide hole; and a nozzle mounted inside the rear panel of the rotary drum, and includes perforations to spray the wash water passing through the guide hole and the opening into the rotary drum.

11. The drum type washing machine according to claim 1, wherein the water circulation device circulates the wash water so as to improve a washing effect of the washing machine and solubility of detergent contained in the wash water.

12. A washing machine comprising:

a cabinet which defines an outer appearance of the washing machine;

a fixed drum set in the cabinet to contain wash water therein;

a rotary drum rotatably set inside the fixed drum to contain laundry therein;

a rotary shaft which drives the rotary drum;

a pump unit which pumps out the wash water contained in the fixed drum; and a water circulation device which temporarily holds and sprays the wash water pumped out by the pump unit directly inside the rotary drum, wherein the water circulation device comprises:

a storing unit which is provided between rear panels of the fixed and rotary drums, and defines a space to temporarily hold the wash water; and a spraying unit which is provided at the rear panel of the rotary drum, communicates with the storing unit and sprays the wash water contained in the storing unit into the rotary drum.

13. The washing machine according to claim 12, wherein the water circulation device circulates the wash water to improve solubility of detergent contained in the wash water, and sprays the wash water directly to the laundry contained in the rotary drum so as to enhance washing of the laundry.

14. The washing machine according to claim 12, wherein the storing unit includes:

a first projecting member provided at a center portion of the rear panel of the fixed drum so as to be projected toward the rotary drum;

a second projecting member which is provided at a center portion of the rear panel of the rotary drum so as to be projected toward the rear panel of the fixed drum, receives the rotating shaft, and surrounds the first projecting member to form the space; and a sealing unit which seals a gap between the first and second projecting members.

15. The washing machine according to claim 14, wherein the sealing unit comprises:

a friction ring arranged between an outer surface of the first projecting member and an inner surface of the second projecting member; and a retainer which holds the friction ring, wherein an outer edge of the retainer is inserted into the friction ring and an inner edge of the retainer is mounted to the first projecting member.

16. The washing machine according to claim 15, wherein the spraying unit includes:

a guide hole which communicates with the storing unit; and a nozzle part having perforations to spray the wash water passing through the guide hole into the rotary drum.

17. The washing machine according to claim 16, wherein the water circulation device further comprises a duct which is provided on an outer surface of the rear panel of the fixed drum, communicates with the storing unit, and includes a connecting port connected to an outlet of the pump.

18. The washing machine according to claim 17, further comprising a valve which is provided between the connecting port and the outlet, and selectively guides the wash water to the duct and a wash water drain hose of the washing machine according to operation of the washing machine.

19. The washing machine according to claim 16, wherein spraying unit rotates along with the rotary drum.

* * * * *